US005206109A

United States Patent [19]

Anno

[11] Patent Number: 5,206,109

[45] Date of Patent: Apr. 27, 1993

[54] PRODUCTION METHOD OF PARTICLES FOR DEVELOPER COMPONENT

[75] Inventor: Masahiro Anno, Sakai, Japan

[73] Assignee: Minolta Camera Kabushiki Kaisha, Osaka, Japan

[21] Appl. No.: 687,007

[22] Filed: Apr. 18, 1991

[30] Foreign Application Priority Data

Apr. 20, 1990 [JP] Japan ..... 2-105925

[51] Int. Cl.[5] ..... G03G 9/083

[52] U.S. Cl. ..... 430/137; 430/106.6; 427/393.5

[58] Field of Search ..... 430/109, 106.6, 110, 430/137

[56] References Cited

U.S. PATENT DOCUMENTS 4,835,082 5/1989 Koishi et al. ..... 430/109

4,965,158 10/1990 Gruber et al. ..... 430/137

FOREIGN PATENT DOCUMENTS 59-37553 3/1984 Japan .

*Primary Examiner*—John Goodrow

*Attorney, Agent, or Firm*—Burns, Doane, Swecker & Mathis

[57] ABSTRACT

This invention relates to a particle production method of a developer component for developing electrostatic latent images comprising;

a step of producing core particles, a step of mixing the core particles with fine particles for surface modification by a mixing means to adhere the fine particles to the surfaces of the core particles;

a step of fixing the fine particles on the surfaces of the core particles by a fixing means; and a step of heat-treating the core particles having the fine particles fixed on the surfaces thereof in a hot gas current at 200°-600° C. by a heating means to fix firmly the fine particles on the surfaces of the core particles.

28 Claims, 3 Drawing Sheets a : revolution direction of magnet roll
b : migration direction of developer

PRODUCTION METHOD OF PARTICLES FOR DEVELOPER COMPONENT

BACKGROUND OF THE INVENTION

This invention relates to a production method of developer components such as toner particles and carrier particles.

With respect to a developer for developing electrostatic latent images, a single-component developer of (non-)magnetic toner particles or a two-component developer containing toner particles and carrier particles is widely used in response to developing system.

There are proposed many kinds of composite toner particles for one-component developer or two-component developer because various physical properties, such as coloring properties, fixing properties, chargeability, fluidity and the like, are requested generally.

The composite toner particle is constituted of plural layers each of which has specified properties, such as fixing properties, chargeability and the like. As chargeability of toner for example, depends much on physical properties of the surface of toner, a charge controlling agent need not to be contained inside the toner but on the surface of the toner to achieve the object of the addition of the charge controlling agent. Further, a layer of resin particles is often formed on the surface of toner.

In conventional formation of the composite toner particles, fine particles for surface modification, such as a charge controlling agent, resin particles and the like, are adhered to the surface of core particles by aid of van der Waals force, electrostatic force and then given impact force in high speed current to be settled thereon.

However, as the fine particles are, in a sense, hammered into the core particle by impact force to be merely settled on the surface of the core particle, they are apt to separate from the core particle when mixed and stirred with carrier particles for frictional electrification. The separated fine particles scatter inside a copy machine and have many harmful influences, such as pollution, fogs on copied images and the like. The separation of the fine particles causes the deterioration of uniformity of many characteristics of toner.

As the surface of core particle is uneven, some fine particles adhere to hollow portions. Such particles are liable to be not settled even when treated by impact force in high-speed current. Therefore, it is difficult to modify the surface of toner uniformly This phenomenon become more remarkable as the ratio of fine particles increases.

Toner particles inferior in uniformity of the surface, for example, are electrically charged oppositely or not charged sufficiently, and bring about problems, such as scattering in a copy machine, pollution and the like.

With respect to carrier utilized in a two component developer, many kinds of composite carriers are proposed. The many problem as above mentioned also the case with the carriers.

In conventional techniques, many kinds of composite toners are proposed (for example, Japanese Patent Laid-Open Sho 62-209541) in which many kinds of fine particles (for example, a charge controlling agent) having a one fifth or less size of core particle are adhered to the surface of resinous core particle and then the fine particles are settled by shearing force. However, a heat treatment is not carried out to modify the surface uniformly as will be disclosed by the present application below. Japanese Patent Laid-Open Sho 59-37553 discloses that binder resin and fine particles are mixed to be subjected to heat-treatment in hot current at 200°-600° C. However, as the binder resin and the fine particles are merely mixed, the fine particles do not adhere to the binding resin uniformly. Even if such a product is treated in hot-current, the fine particles can not be fixed uniformly. In a conventional method, when such a mixture as described above is treated in hot current, binder resin particles themselves aggregate and fuse. In particular, it is almost impossible that fine resin particles are treated to form a layer.

SUMMARY OF THE INVENTION

The object of the invention is to provide a production method of toner particles which do not have problems caused by merely adhering and settling treatment of fine particles by giving impacts in high-speed current, for example, non-uniform modification of surface, separation and scattering of fine particles, fogs on copied images caused by toner scattering, pollution inside a copying machine.

Another object of the invention is to provide a production method of carrier particles having no problems, such as non-uniform modification of surface, separation of fine particles, and the like.

DETAILED DESCRIPTION OF THE INVENTION

Figure 1:
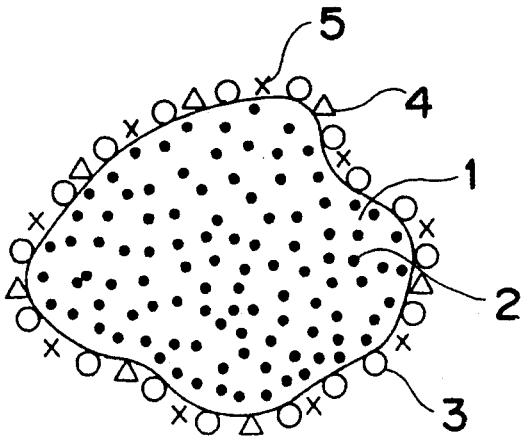
FIG. 1 and FIG. 2 show respectively a sectional view of toner prepared by the present invention.

The present invention provides a production method of developer components, such as toner particles and carrier particles which show stable properties and no scattering of fine particles.

The present invention has accomplished the above-stated objects by giving an additional fixing treatment to fine particles settled on the surfaces of developer components.

The present invention relates to a particle production method of a developer component for developing electrostatic latent images comprising;

a step of producing core particles, a step of mixing the core particles with fine particles for surface modification by a mixing means to adhere the fine particles to the surfaces of the core particles;

a step of fixing the fine particles on the surfaces of the core particles by a fixing means; and a step of heat-treating the core particles having the fine particles fixed on the surfaces thereof in a hot gas current at 200°-600° C. by a heating means to fix firmly the fine particles on the surfaces of the core particles.

The developer components include a toner particle and a carrier particle in the present invention. First of all, the production method of composite toner particles are described below.

Fine particles for surface modification are adhered uniformly and settled on surfaces of core particles of toner.

The core particles play a toner-fixing part. Conventional binder resins can be used without limit for the core particle of toner. Such binder resins are exemplified by thermoplastic resins, such as polystyrene resins, poly(metha)acrylic resins, polyolefin resins, polyamide resins, polycarbonate resins, polyether resins, polysulfone resins, polyester resins, epoxy resins and the like, thermosetting resins, such as urea resins, urethane resins, epoxy resins, copolymers thereof, black copolymers thereof, a mixture thereof, and the like.

The resins for the core particles are not necessarily in final polymer form but may be in a form, such as an oligomer, a prepolymer or the like which may contain a crosslinking agent.

The core particles for toner may be prepared by a known method. In one example, a binder resin and other necessary components are mixed, kneaded, pulverized and classified to obtain the core particles. In other example, at least a binder resin is dissolved in an organic solvent and then the obtained solution is dispersed in an dispersing medium to granulate the solution. In another method, monomers for forming a binder resin are dissolved in an organic solvent, the obtained solution is dispersed in a dispersing medium with stirring to form drops of oil having desired size, and then the monomers are polymerized to prepare core particles.

Recently, a copying system in which copying speed is higher than conventional is desired. A toner used in such a high speed copying system is required to be fixed on copy paper in a short time and to be separated effectively from a fixing roller. Therefore, the improvement of fixing properties and separating properties are needed. The core particle resin used in high-speed copying system is preferably exemplified by homopolymers or copolymers which are synthesized from styrene monomers, (metha)acrylic monomers, (metha)acrylate monomers and the like, or polyester resins. The desirable molecular weight of those resin shows the relationships between number average molecular weight (Mn), weight average molecular weight (Mw) and Z average molecular weight (Mz) as below;

$$1000 \leqq Mn \leqq 7000$$

$$40 \leqq Mw/Mn \leqq 70$$

$$200 \leqq Mz/Mn \leqq 500.$$

More desirable resin has number average molecular weight (Mn) of 2000–7000.

When a toner is applied to an oilless fixing process, a desirable resin is the one having glass transition point of 55°–80° C., softening point of 80°–150° C., and further containing gel components of 5–20 percent by weight.

Polyester resins are paid attention to from the view points of resistance to transference of copied images to a sheet made of polyvinyl chloride, and light-transmittance required for light-transmittable color toner and adhering properties to OHP sheet.

When the polyester resin is applied to the light-transmittable toner, a linear polyester resin is desirable, which has a glass transition point of 55°–70° C., a softening point of 80°–150° C., number average molecular weight (Mn) of 2000–15000, and distribution of molecular weight (Mw/Mn) of 3 or less.

An linear polyester resin (a) which is treated with diisocyanate (b) for urethane modification (the polyester resin thus modified is referred to as urethane-modified linear polyester resin hereinafter) is used. In more detail, the urethane-modified linear polyester is prepared by treating one mole of polyester resin composed of dicarboxylic acid and diol in which the end group is hydroxy group in substance and the number average molecular weight of 2000–15000, and the acid value is 5 or less, with 0.3–0.95 moles of diisocyanate. The urethane-modified linear polyester resin has glass transition point of 40°–80° C. and acid value of 5 or less at the same time. Further, the polyester resin may be modified by graft polymerization or block polymerization with acrylic monomers or aminoacrylic monomers so far as transition temperature, softening point and molecular weight are the same as those of urethane-modified linear polyester resin.

The size of core particles of toner is adjusted to the same as or one or two microns smaller than that of final toner particles depending on the object of modification.

Off-set prevention agents may be incorporated into the core particles of toner to improve fixing properties. Off-set prevention agents are exemplified by various kinds of wax, preferably polyolefin wax such as low molecular weight polypropylene, low molecular weight polyethylene, polypropylene of oxidized type and polyethylene of oxidized type. More preferable wax is the one that has in number average molecular weight (Mn) of 1000–20000, softening point (Tm) of 80°–150° C. If the number average molecular weight (Mn) is less than 1000 or the softening point (Tm) is less than 80° C., the wax particles can not be dispersed uniformly in binder resin, resulting in the eluation of the wax to the surface of toner particles. The eluation of wax not only may have undesired influences on toner preservation and development but also may cause the pollution of photosensitive member by toner filming phenomenon. If the number average molecular weight (Mn) is more than 20,000 or the softening point (Tm) is more than 150° C., the compatibility of wax with resin becomes poor and the effects of wax, such as off-set resistance at high temperature or the like, can not be obtained. When the binder resin of toner contains polar groups, desirable wax is the one that also contains polar groups.

Fine particles for surface modification which adhere to and are settled on the core particles of toner are exemplified by a charge controlling agent, a fluidizing agent, a colorant, organic fine particles, non-magnetic inorganic fine particles, magnetic inorganic fine particles. The charge controlling agent is used in order to adjust chargeability of toner, and exemplified by a positive-charge controlling agent, such as Nigrosine base EX (azine compound), Bontron N-01, 02, 04, 05, 07, 09, 10, 13 (all made by Orient Kagaku Kogyo K. K.), Oil Black (made by Tyuo Gosei Kagaku K. K.), Quarternary Ammonium Salt P-51, Polyamine Compound P-52, Sudan Schwaltz BB (Solvent Black 3: Color Index No. 26150), Fett Schwaltz HBN (C.I. No. 26150), Brilliant Spirit Schwaltz TN (made by Farbenfabriken Bayer K. K.), alkoxylated amine, alkyl amide, molybdic acid chelate pigment, imidazole compound or the like.

A negative charge-controlling agent are exemplified by azo dyes of chromium complex type of S-32, 33, 34, 35, 37, 38, 40 and 44 (made by Orient Kagaku Kogyo K. K.). Aizen Spilon Black TRH ad BHH (made by Hodoya Kagaku K. K.), Kayaset Black T-22 and 004 (made by Nihon Kayaku K. K.) of copper phthalocyanine series S-39 (made by Orient Kagaku Kogyo K. K.), Chromium Complex Salt E-81 and 82 (made by Orient Kagaku Kogyo K. K.), Zinc Complex Salt E-84 (made by Orient Kagaku Kogyo K. K.), Aluminum Complex Salt E-86 (made by Orient Kagaku Kogyo K. K.), Salicylic Acid Metal Complex E-81 (made by Orient Kagaku Kogyo K. K.) and the like.

An addition amount of the charge controlling agents should be adjusted suitably according to kind of toner, kind of additives, kind of binder resin or toner-developing method (two-component or single component). But, when the charge controlling agents are adhered to and settled on the surface of core particles of toner, 0.001–10 parts by weight, preferably 0.1–5 parts by weight, more preferably 0.5–3 parts by weight of the agents are added on the basis of 100 parts by weight of core particles of toner. If the addition amount is less than 0.001 part by weight, charge amount becomes lack because the amount of the charge controlling agent on the surface of toner is small. If the addition amount is more than 10 parts by weight, the some particles of charge controlling agent do not adhere to the surface of toner sufficiently and such particles separate at practical use.

The charge controlling agent may be incorporated inside the core particles. When the charge controlling agent is added inside the toner, the addition amount thereof is 0.1–20 parts by weight, preferably 1–10 parts by weight on the basis of 100 parts by weight of resin for toner composition. If the amount is smaller than 0.1 part by weight, desirable charge amount can not be obtained. If the addition amount is higher than 20 parts by weight, the charge amount becomes unstable and fixing properties deteriorate.

Colorants adhered to and settled on toner for electrophotography are exemplified by various kinds of organic and inorganic pigments and dyes as follows;

for black pigments, carbon black, cupric oxide, manganese dioxide, aniline black, activated carbon, nonmagnetic ferrite, magnetic ferrite, magnetite and the like;

for a yellow pigment, is available chrome yellow, zinc yellow, cadmium yellow, yellow oxide, mineral fast yellow, nickel titanium yellow, nables yellow, naphthol yellow S, hansa yellow G, hansa yellow 10G, benzidine yellow G, benzidine yellow GR, quinoline yellow lake, permanent yellow, NCG, tartrazine lake and the like;

for an orange pigment, is available chrome orange, molybdenum orange, permanent orange GTR, pyrazolone orange, vulcan orange, indanthrene brilliant orange RK, benzidine orange G, indanthrene brilliant orange GK and the like;

for a red pigment, is available red iron oxide cadmium red, red lead oxide, cadmium mercury sulfide, permanent red 4R, lithol red, pyrazolone red, watchung red, calcium salt, lake red C, lake red D, brilliant carmine 6B, eosine lake, rhodamine lake B, alizarin lake, brilliant carmine 3B and the like;

for a purple pigment is available manganese violet, fast violet B, methyl violet lake and the like;

for a blue pigment is available prussian blue cobalt blue, alkali blue lake victoria blue lake, phthalocyanine blue, metal-free phthalocyanine blue, phthalocyanine blue partial chlorine compound, fast sky blue, indanthrene blue BC and the like;

for a green pigment, is available chrome green, chrome oxide green, pigment green B, malachite green lake, fanal yellow green G and the like;

for white pigment, is available zinc white, titanium oxide, antimony white, zinc sulfide or the like; and for an extender pigment, is available powdery barytes, barium carbonate, clay, silica, white carbon talc, alumina white or the like.

Various kinds of dyes such as basic dyes, acid dyes, disperse dyes, and direct dyes, nigrosine, methylene blue, rose bengale, quinoline yellow, ultramarine blue can be used.

In use, one or more than two of them can be mixed.

When the colorant is adhered to and settled on the surface of toner particles, 1–20 parts by weight, preferably 3–15 parts by weight, more preferably 5–10 parts by weight of colorants are used on the basis of 100 parts by weight of core particles of toner. If the usage of the colorant is smaller than one part by weight, desired density of copied images can not be achieved. If the usage is higher than 20 parts by weight all particles of colorants can not be sufficiently adhered to and settled on the surface of toner, resulting in scattering of colorants.

When the colorant is contained inside the core particles of toner, desirable usage thereof is 1–20 parts by weight on the basis of 100 parts by weight of resin for core particle composition. If the content is higher than 20 parts by weight, fixing properties of toner are deteriorated. If the content is smaller than 1 part by weight, desired density of copied images can not be achieved.

Colorants for light-transmittable color toner are exemplified by various kinds of pigments and dyes as follow; for a yellow pigment, is available. C. I.10316 (naphthol yellow S), C.I.11710 (Hansa yellow 10 G), C.I.11660 (Hansa yellow 5G), C.I.11670 (Hansa yellow 3G), C.I.11680 (Hansa yellow G), C.I. 11730 (Hansa yellow GR), C.I.11735 (Hansa yellow A), C.I.11740 (Hansa yellow RN), C.I.12710 (Hansa yellow R), C.I.12720 (pigment yellow L), C.I.21090 (benzidine yellow), C.I.21095 (benzidine yellow G), C.I.21100 (benzidine yellow GR), C.I.20040 (permanent yellow NCG), C.I.21220 (vulcan fast yellow 5), C.I.21135 (vulcan fast yellow R) or the like.

For a red pigment, is available C.I.12055 (sterling I), C.I.12075 (permanent orange), C.I.12175 (lithol fast orange 3GL), C.I.12305 (permanent orange GTR), C.I.11725 (hansa yellow 3R), C.I.21165 (vulcan fast orange GG), C.I.21110 (benzidine orange G), C.I.12120 (permanent red 4R) C.I: 1270 (para red), C.I.12085 (fire red), C.I.12315 (brilliant fast scarlet), C.I.12310 (permanent red F 2R), C.I.12335 permanent red F4R), C.I.12440 (permanent red FRL), C.I.12460 (permanent red FRLL), C.I.12420 (permanent red F4RH), C.I.12450 (light fast red toner B), C.I.12490 (permanent carmine FB), C.I.15850 (brilliant carmine 6B) and the like.

For a blue pigment, is available C.I. 74100 (metal-free phthalocyanine blue), C.I.74160 (phthalocyanine blue), C.I.74180 (fast sky blue) or the like.

Such colorants can be used singly or in combination with other colorants.

When such a colorant is adhered to and settled on the surface of toner particles, 0.5–10 parts by weight, preferably 1–5 parts by weight of colorants are used on the basis of 100 parts by weight of core particles of toner. If the usage of the colorant is smaller than 0.5 parts by weight, desired density of copied images can not be achieved. If the usage is higher than 10 parts by weight, light-transmittance is deteriorated.

When the colorant is contained inside the core particles of toner, desirable usage thereof is 0.5–10 parts by weight, preferably 1–5 parts by weight on the basis of 100 parts by weight of resin for core particle composition. If the content is higher than 10 parts by weight, fixing properties and light transmittance of toner are deteriorated. If the content is smaller than 0.5 parts by weight, desired density of copied images can not be achieved. Non-magnetic fine particles are used in order to improve characteristics of toner, such as chargeability, fluidity, developing properties, cleaning properties, transferring properties and the like. Such non-magnetic inorganic fine particles are exemplified by carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide, diamond carbon random and the like, nitrides, such as boron nitride, titanium nitride zirconium nitride and the like, borides, such as zirconium boride and the like, oxides, such as iron oxide, chromium oxide, titanium oxide, calcium oxide, magnesium oxide, zinc oxide, copper oxide, aluminum oxide, silica, colloidal silica, hydrophobic silica and the like, sulfides, such as molybdenum sulfide and the like, fluorides, such as magnesium fluoride, carbon fluoride and the like, metal soaps, such as aluminum stearate, calcium stearate, zinc stearate, magnesium stearate and the like, talc, bentonite and the like. It is desirable that these fine particles are subjected to hydrophobic treatment.

With respect to organic fine particles, there is exemplified by polystyrenes, (metha)acrylic polymers, benzoguanamine polymers, melamine polymers, Teflons, silicon polymers, polyethylenes, polypropylenes and the like, which prepared by wet polymerization methods, such as emulsification polymerization, soap-free emulsification polymerization, nonaqueous suspension polymerization and the like, or a gas phase method. These organic fine particles are used in order to improve characteristics of toner, such as chargeability, fluidity, heat-resistance, cleaning properties and the like.

In particular, particles formed of a thermoplastic resin, such as styrene resins, methacrylic resins, polyethylenes and the like are welded with and fused to core particle resin more strongly by heat-treatment in hot gas current described later. At the same time, other fine particles for surface modification, such as a charge controlling agent, colorants and the like are fixed strongly on core particles of toner. By adjusting the amount of thermoplastic fine particles, colorant particles and the like can be overcoated completely with the thermoplastic particles to form a resin layer. Thereby, harmful influences caused by the outcroppings of colorant particles can be prevented to improve stability of chargeability and heat resistance of toner.

The charge controlling agents, colorants and the like may be incorporated into core particles in advance.

The fluidizing agents adhered to and settled on the core particles are exemplified by silica, aluminum oxide, titanium oxide, magnesium fluoride and the like. These fluidizing agents may be used singly or in combination, and may be used by being mixed with resultant toner.

In order to make the fine particles for surface modification adhere to and settle on the surface of toner core particles, the core particles and the desired fine particles for surface modification are mixed at specified amount to make the fine particles for surface modification adhere to the surfaces of core particles.

The adherence of the fine particles for surface modification to the surfaces of core particles can be carried out by conventional mixing methods and machines, such as Henschel Mixer (made by Mitsui Miike Kakoki K. K.), Homogenizer (made by Nippon Seiki Seisakusyo K. K.) Multi Blender (made by Nippon Seiki Seisakusyo K. K.), Hi-X (made by Nisshin Seihun K. K.), OM Dizer (made by Nara Kikai Seisakusho K. K.) and the like. In this process, the fine particles for surface modification do not adhere to the surfaces of core particles uniformly. The adhering force is small because it caused by electrostatic force.

The adhered fine particles are fixed on the surfaces of core particles by giving the fine particles the mechanical impact force, or by a wet coating method, a dry mechanochemical method. Thereby, the fine particles for surface modification can be fixed uniformly on the surfaces of core particles. The whole surface of core particle shows uniform quality. Such a uniformity can not be achieved by merely mixing core particles with fine particles to adhere the fine particles to the core particles. The mechanical impact force is generated from a shearing force of a rotator and stator, and collision of particles themselves. In such a process, for example, Hybridization System (made by Nara Kikai Seisakusyo K. K.) Cosmos System (made by Kawasaki Jukogyo K. K.) and the like may be used.

In the wet coating method, the surfaces of core particles are dissolved partially by use of a solvent and the like. Thereby, the particles for surface modification adhere to and fix on the surfaces of core particles. In such a process, for example, Dispacoat (made by Nisshin Seihun K. K.) or Coatmizer (made by Freund Industrial CO., LTD.) and the like may be used.

The dry mechanochemical method utilizes the heat generated from friction, compress and shearing force between the particles themselves or between the particles and the members of machines to fix the fine particles for surface modification on the surfaces of core particles. In such a process, for example, Mechanofusion System (made by Hosokawa Mikuron K. K.), Mechanomill (made by Okada Seiko) and the like may be used.

Preferred means in toner production is Hybridization System (made by Nara Kikai Seisakusyo K. K.) in which a impact method is applied in high speed current or Cosmos System (made by Kawasaki Jukogyo K. K.) because they are suitable for treatment of fine particles and moreover the accumulation of heat is small.

The mean particle size of fine particles for surface modification is adjusted to a fifth of the mean particle size of core particles or less, preferably a twentieth thereof or less. If the mean particle size of fine particles is larger than a fifth of the mean particle size of core particles, a uniform treatment on the surface becomes difficult. If the fine particles are too small, the second aggregation need to be broken.

In the present invention, after the fine particles for surface modification are adhered to and fixed on the surfaces of core particles, the resultant particles are further subjected to heat-treatment in a hot gas current to fix firmly the fine particles on the surfaces of core particles uniformly. Thereby, the fine particles fixed on the surfaces are fused partially to core particles to be set more strongly. In such a process, a machine for instant treatment in hot gas current, such as Surfusing System (made by Nippon Pneumatic MFG. CO., LTD.) may be used. The fine particles for surface modification fixed on the surfaces of core particles are hard to separate from the toner particles and the properties of fine particles for surface modification are provided uniformly for the whole surfaces of core particles. A temperature at heat treatment is set at higher temperature than melting point of the core particle resin and that of fine particle resin, in particular, at 200°-600° C., preferably 200°-400° C., more preferably 250°-350° C. If the heat-treatment is carried out at a temperature higher than 600° C., particles become liable to aggregate together and the compositions of toner may decompose partially to deteriorate chargeability and coloring power. If the temperature is lower than 200° C., the fine particles for surface modification can not be fixed uniformly. An structural example of the composite toner particle of the present invention is shown in FIG. 1.

A layer composed of a polymer fine particle (3), a charge controlling agent (4) and a fluidizing agent (5) is formed on a toner core particle (1) containing a colorant (2). This type of toner may be thought to have a layer containing a fluidizing agent and a charge controlling agent on the surface of core particle (1). Such a structure of toner is to modify fluidity and chargeability.

The toner having the structure of FIG. 1 can be prepared by adhering the polymer fine particles (3), the charge controlling agent (4) and the fluidizing agent (5) to the core particles (3) and then mechanical impacts are provided to fix them on the surface. Then, the resultant is subjected to the heat-treatment in a hot gas current to melt partially the fine polymer particle (3) and the core particle (1), followed by welding to fuse and fix firmly the charge controlling agent (4) and the fluidizing agent (5) to the surface of the core particle (1).

Figure 2:
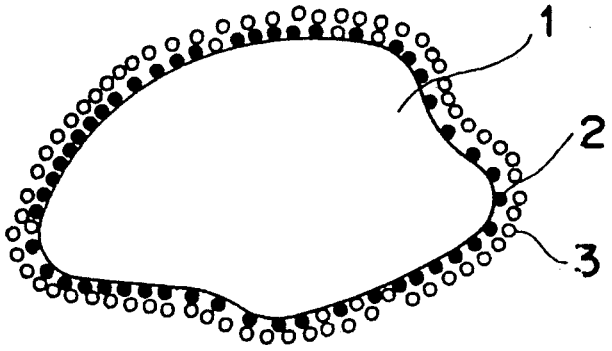

In FIG. 2, a toner with three layer structure in which a colorant (2) layer and a fine particle (3) layer are formed on a core particle (1) is shown.

Such a structure of toner can be prepared by adhering the colorant particles (2) to the surface of the core particle (1) and settling them by mechanical impact, followed by adhering and fixing fine resin particles (3). Then, the resultant is subjected to the heat-treatment in a hot gas current.

Thereby, the fine resin particles melt and weld themselves or with the surface of the core particle to form a resin layer with the colorant layer covered. The colorant exists on the surface of core particle, so that the usage of the colorant can be decreased and the fixing properties of core particles can be improved. The outermost resin layer effects to prevent colorant-scattering, to ensure chargeability and to prevent bad influences caused by outdropping of colorant.

The two structures of toner obtained according to the production method of the present invention are exemplified as above mentioned. But, other fine particles may be used adequately in combination with toner core particles to be adhered to, fixed on and fixed on the surface of the core particles strongly, so that the desired properties can be obtained. In particular, when a resin layer is formed as an outermost surface as shown in FIG. 2, the properties of resin makes it possible to improve stability of chargeability and heat-resistance. Further, plural layers, each layer of which contains desired surface-modifier and additives, can be formed on the surface of toner core particle easily.

The application of the present invention to carrier is explained hereinafter. The surface of carrier is modified in a manner similar to toner. Namely, various kinds of organic materials and inorganic materials are adhered and settled in order to improve many developing properties, such as chargeability and the like. Such a carrier which fine particles are adhered to and fixed on for surface modification is exemplified by iron carrier, ferrite carrier and the like, which are constituted of an alloy or a mixture of metals, such as iron, nickel, cobalt and the like with metals, such as zinc, antimony, aluminum, lead, tin, bismuth, beryllium, manganese, selenium, tungsten, zirconium, vanadium and the like, a mixture of metaloxides, such as titanium oxide, magnesium oxide and the like, nitrides, such as chromium nitride, vanadium nitride and the like and carbides, such silicon carbide, tungsten carbide and the like, ferromagnetic ferrite and a mixture thereof.

The iron carrier or the ferrite carrier may be the one which is coated with various kinds of synthetic resins or ceramics.

The synthetic resins are exemplified by thermoplastic resins or thermosetting resins, such as polystyrenes, poly(metha)acrylate, polyolefins, polyamides, polycarbonates, polyethers, polysulfinic acids, polyesters, epoxy resins, polybutyral resins, urea resins, urethane/urea resins, silicon resins, polyethylenes, Teflon resins, a mixture thereof, a copolymer thereof, a block copolymer thereof, graft copolymer thereof, a polymer blender thereof and the like. A resin having polar group may be used in order to improve chargeability. Various kinds of ceramic materials are coated by means of a heat-spray method, a plasma method, a sol-gel method, and the like.

A binder type carrier may be used, which is prepared by mixing, kneading and grinding magnetic materials, synthetic resins (used for the formation of coating layer as above mentioned) as a binder resin, and if necessary, organic and/or inorganic materials, to adjust particle size desirably.

The carrier having the mean particle size of 20-200 μm, preferably 30-100 μm is used in general. But, the particle size may be adjusted properly depending on developing system. In general, the particle size of carrier is smaller than 20 μm, such a problem that the carrier particles themselves are developed is brought about. If the particle size of carrier is larger than 200 μm, the texture of copied images becomes rough.

The fine particles for surface modification, such as fluidizing agent, charge controlling agent and the like may be the same as used for toner production, and may be fixed in a manner similar to that of toner. Preferred means is Mechanofusion System (made by Hosokawa Mikuron K. K.) or Mechanomill (made by Okada Seiko K. K.). Mechanofusion System can accumulate heat adequately to make it possible to weld and fuse a thermoplastic resin to core particles, as the treatment thereof is carried out mildly, even large particles, such as carrier and the like are not broken to be small.

Iron or ferrite which is not coated with thermoplastic resin need to be treated together with thermoplastic resin particles; otherwise, the fine particles can not be adhered to or fixed on the surface of metals, such as iron and the like.

The fine particles for surface modification may selected suitably according to the desired intention. In case of need, the fine particles may be contained in a coating resin, or a binder resin of binder-type carrier.

After the fine particles for surface modification are adhered to the surfaces of carrier cores, the resultant are subjected to heat-treatment in a hot gas current in a manner similar to that of toner.

Thus, the surfaces of carrier particles can be modified uniformly. The uniformity is not deteriorated even though the carrier particles are stirred with the toner particles under a little vigorous conditions.

| Preparation of toner (a) and (A) | |
|---|---|
| ingredient | parts by weight |
| polyester resin (Tafton NE-382; made by Kao Sekken K.K.) | 100 |
| Brilliant carmine 6B (C.I. 15850) | 3 |

The above ingredients were mixed sufficiently in a ball mill, and kneaded over a three-roll heated to 140° C. The kneaded mixture was left to stand for cooling the same, and then was coarsely pulverized with the use of a feather mill. The obtained coarse particles were further pulverized under jet stream, followed by being air-classified to obtain toner core particles (a) having mean particle size of 7 μm. Further, the obtained toner core particles (a) of 100 parts by weight, MMA/iBMA(1/9) polymer fine particles MP-4951 (mean particle size of 0.2 μm, glass transition point of 85° C.; made by Soken Kagaku K.K.) of 15 parts by weight, the imidazole compound [A] having mean particle size of 0.8 μm and the chemical structure below;

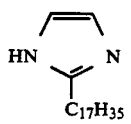

[A]

of one part by weight, quaternary ammonium salt P-51 (1.8 μm; made by Oriento Kagaku Kogyo K.K.) of 0.5 parts by weight were put into Henschel Mixer and stirred at 1500 rpm for two minutes, so that the fine particles and additives adhered to the surfaces of toner core particles (a) with the help of Van der Waals force and electrostatic force. Then, the obtained particles were treated at 7200 rpm for 3 minutes in Hybridization System NHS-1 Type (made by Nara Kikai Seisakusyo K.K.) to obtain toner A having mean particle size of 8 μm. The obtained Toner (A) of 100 parts by weight and hydrophobic silica R-974 (mean particle size of 17 mμ; made by Nippon Aerojil K.K.) were put into Henschel Mixer to be mixed and stirred at 1500 rpm for 1 minute. The obtained particles were further treated a hot-air current surface modifier (Surfusing System; made by Nippon Pneumatic MFG. CO., LTD.) at 350° C. for about 1 second in a hot air current to obtain toner (a) having mean particle size of 8 μm.

Preparation of toner (b) and (B)

One hundred parts by weight of copolymer particles (mean particle size of 5 μm; glass transition point of 54° C.; softening point of 128° C.; gel-containing ratio of 1.5% (insoluble in toluene) prepared by polymerizing styrene and n-butyl methacrylate according to seed polymerization method being spherical and in single distribution, 8 parts by weight of carbon black (MA#8); made by Mitsubishi Kasei Kogyo K.K. were put into Henschel Mixer to be mixed and stirred at 1500 rpm for 2 minutes so that carbon black adhered to the surfaces of polymer particle. Then, the obtained particles were treated in Hybridization System NHS-1 (made by Nara Kikai Seisakusyo K.K.) at 6000 rpm for 3 minutes, so that carbon black were fixed on the surfaces on the polymer particles.

One hundred parts by weight of polymer particles treated with carbon black and 20 parts by weight of MP-4951; MMA/iBMA (1/9) particles (mean particle size of 0.1 μm; glass transition point of 85° C.; made by Soken Kagaku K.K.) and one part by weight of zinc complex E-84 (made by Oriento Kagaku Kogyo K.K.) were treated in Hybridization System at 7200 rpm for 3 minutes, so that Toner (B) having 3 layers and mean particle size of 6 μm. Further, the obtained Toner (B) were treated in a hot air current in a manner similar to preparation of Toner (a) except that silica was not added. Toner (b) having mean particle size of 6 μm was obtained.

| Preparation of toner (c) and (C) | |
|---|---|
| ingredient | parts by weight |
| styrene-n-butyl methacrylate softening point of 132° C., glass transition point of 60° C.) | 100 |
| Carbon black (MA#8; made by Mitsubishi Kasei Kogyo) | 8 |
| polypropylene of low molecular weight (Biscol 550P; made by Sanyo Kasei Kogyo K.K.) | 5 |

The above ingredients were mixed, kneaded, ground and classified in a manner similar to so that toner core particles (b) having mean particle size of 7 μm were obtained. One hundred parts by weight of the obtained toner core particles (b) and one part by weight of the compound [A] were treated in Hybridization System at 6000 rpm in a manner similar to preparation of Toner (A).

So that the compound [A] was adhered to and fixed on the surfaces of toner core particles (b). Thus, Toner (C) having mean particle size of 7 μm was obtained. The obtained Toner (C) was treated in a hot air current in a manner similar to Preparation of Toner (a), so that Toner (c) having mean particle size of 7 μm was obtained. Toners (a), (b) and (c) above obtained were evaluated in Example 1 (Toner (a)), Example 2 (Toner (b)) and Example 3 (Toner (c)) respectively. Toners (A), (B) and (C) above obtained and not being treated in a hot air current were evaluated in Comparative Example 1 (Toner A), in Comparative Example 2 (Toner B) and in Comparative Example 3 (Toner C).

Preparation of Toner D (Comparative)

The same ingredients as those of Example 1 were mixed in Henschel Mixer in a manner similar to Preparation of Toner (a), but the obtained particles were not surface-treated in Hybridization System and subjected only to heat-treatment in a hot air current. Thus, Toner D having mean particle size of 7 μm was obtained.

Preparation of Carrier (A)

A binder type carrier was prepared as follows in order to evaluate the above obtained toners.

| ingredients | parts by weight |
|---|---|
| Polyester resin (NE-1110; made by Kao K.K.) | 100 |
| Inorganic magnetic particles (EPT-1000; made by Toda Kogyo K.K.) | 500 |
| Carbon black | 2 |

-continued

| ingredients | parts by weight |
|---|---|
| (MA#8; made by Mitsubishi Kasei K.K.) | |

The above ingredients were mixed sufficiently in a Henschel mixer, pulverized, melted and kneaded using an extrusion kneader wherein the temperature of cylinder and cylinder head was set to 180° C. and 170° C., respectively. The kneaded mixture was cooled, then pulverized in a jet mill, then classified using a classifier to obtain Magnetic Carrier (A) of an average particle diameter of 55 μm.

Toners (b), (c) and (A)–(D) obtained in Examples and Comparative Examples of 100 parts by weight were treated respectively with hydrophobic silica R-974 of 0.2 parts by weight.

Evaluation

Particle size of toners

The mean particle size of toner particles were obtained by measuring relative weight distribution of particle size with aperture tube of 100 μm by Coulter counter TA-II type (made by Coulter Counter K.K.).

Contents of Fine Particles in Toner

The contents of fine particles in toner were measured as follows. A little amount of toner particles were dispersed in aqueous solution containing a very small amount of surfactant. The obtained dispersion was subjected to supersonic wave treatment and then only carriers were removed from the solution with magnet.

The distribution of toner particle size was measured by a measuring machine for particle size distribution; SALD-1100 (made by Simazu Seisakusyo K.K.). The number of particles having the size of 0.5 μm - one half of the relative weight distribution was measured and calculated on the basis of all toner particles. The ratio (%) of the number of fine particles to the number of all toner particles was referred to as the content of fine particles.

Particle Size of Carrier

The particle size of the carrier was measured with Micro track model 7995-10 SRA (made by Nikkiso K.K.) to obtain means particle size.

Measurement of Charge Amount (Q/M) and Flying Amount

Each two grams of the surface-treated toner and 28 g of carrier were put in a 50 cc poly bottle, and were stirred at 1200 rpm for 10 minutes to evaluate electrification build-up properties, charge amount of toner and toner scattering amount at the same time.

The scattering amount was measured with the use of a digital dust measuring apparatus of P5H2 type (manufactured by Shibata Kagakusha K.K.). The dust measuring apparatus was spaced 10 cm apart from a magnet roll, and 2 g of the developer was set on the magnet roll, which was revolved at 2,000 rpm. Then, the dust measuring apparatus detected the toner particles scattering about as dust, and displayed the resultant value in the number of counts per minute, i.e. cpm.

The results were shown in Table 1. In the table 1, the symbol "○" represents the toner scattering amount of 300 cpm or less, the symbol "Δ", represents the toner scattering amount of 500 cpm or less, and the symbol "x" represents the toner scattering amount of 500 cpm or more. When the rank is higher than "Δ", the toner can be used practically. The preferable rank is "○".

The toner and the carrier selected in the combination shown in Table 1 were mixed at the ratio of toner to carrier of 5/95, so that two-component developers were prepared. These developers were evaluated by forming coped images. The developers in Example 2 and Comparative Example 2 were provided for EP-570 Z (made by Minolta Camera K.K.) and the developers in Examples 1, 3 and Comparative Examples 1, 3, 4 were provided for EP-470Z (made by Minolta Camera K.K.). In particular, the fixing machine was remodeled to the oil-sprayed type in Example 1, Comparative Examples 1 and 4. Initial properties were evaluated as above mentioned. Moreover, the same kinds of properties were evaluated after only the developing machine was driven for 10 hours without forming copied images.

Fogs on the Copied Ground

The developers in the combination of Toners with the Carrier as shown in Table 1 were provided for the copying machines as above mentioned to observe fogs on the copy ground. The degree of fogs was ranked with the symbols "○" and "Δ". The results were shown in Table 1. When the rank is higher than "Δ", the toner can be put into practical use. The preferable rank is "○".

Evaluation on Aggregation of Developer

Fifteen grams of each developer were sampled for evaluation and shifted for 15 seconds with the sieve having the sieve openings of 125 μm, and then the percentage of the residue was calculated to be ranked as follows;

○; percentage of residue is 1 percent or less
Δ; percentage of residue is 3 percents or less
x; percentage of residue is more than 3 percents

Measurement of Charge Distribution

Figure 3:
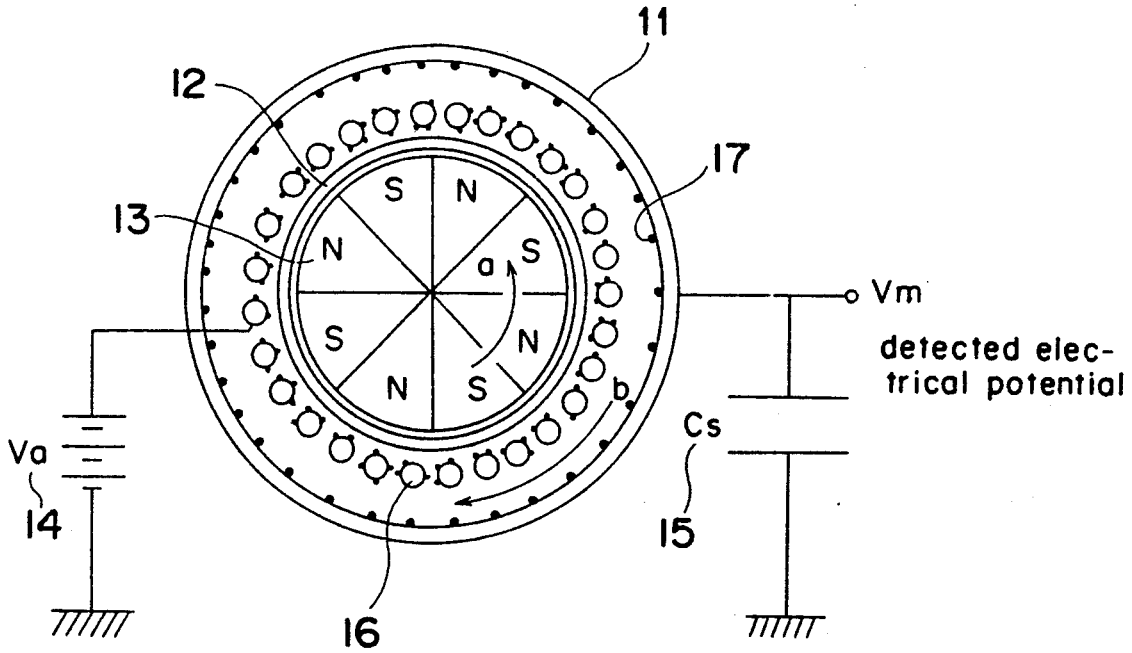
FIG. 3 is a schematic construction of a measuring apparatus of charge amount distribution.

For the measurement of charge distribution, was employed the apparatus published by Mr. Terasaka, et al. of Minolta Camera K.K., in the 58th Meeting for Reading Paper held by the Academy of Electrophotography on November 28 in 1986. Since the theory of the apparatus is described in detail in the pamphlet distributed in the meeting, it is described briefly in this application. FIG. 3 shows its construction.

The measuring procedures are as follows.

Figure 4:
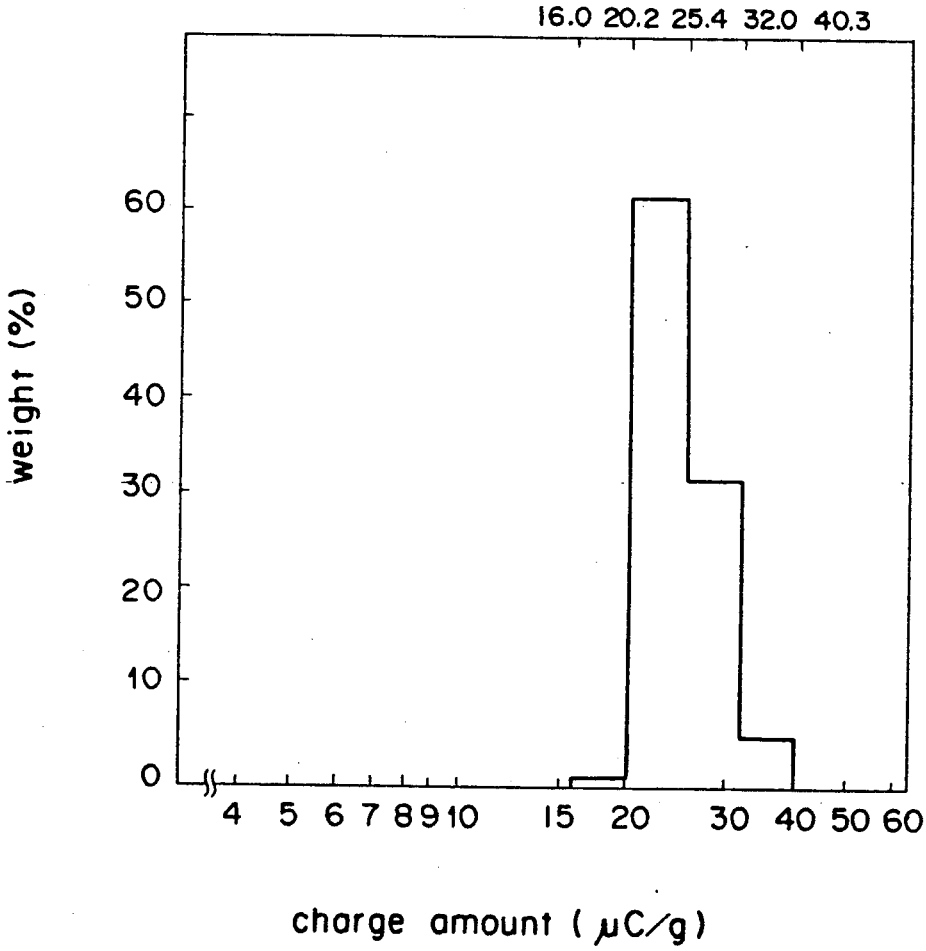
FIG. 4 is an illustrative graph of distribution of charge amount.

The number of revolutions of magnet roll (13) was set to 100 rpm, and the developer stirred for 30 minutes was employed. The developer was weighed in 3 g on a precision balance, and put uniformly on the entire surface of conductive sleeve (12). Then, bias supply (14) was applied zero to 10 KV of bias voltage sequentially, the sleeve (12) was revolved for 5 seconds. After sleeve (12) was stopped, electrical potential Vm was read. In this step, the amount Mi of toner (17) attached to cylindrical electrode (11) was weighed on the precision balance to calculate the average charge amount of toner. FIG. 4 is a graph in which the weight percentage of toner mass calculated in the above way is expressed by the axis of ordinate, and the charge amount Q/M is expressed as a logarithm by the axis of abscissa. FIG. 4 shows the results of the measurement of toner.

In FIG. 4, one division into which the range of $10^0$ to $10^2$ of the axis of abscissa (Q/M) is divided by 20 is taken as one channel, and the accumulated weight percentage of 3 channels which are in order of the larger weight percentage of this channel is calculated. The resultant accumulated weight percentage for each toner is shown in Table 1.

TABLE 1

Evaluation on two-component developer

| Example/ Comparative Example | toner | carrier | Q/M (μC/g) | initial scattering | initial fogs on copying ground | initial total % by weight of 3 channels | initial contents of fine particles (particle number %) |
|---|---|---|---|---|---|---|---|
| Example 1 | a | A | 15 | ○ | ○ | 96 | 0.0 |
| 2 | b | " | 24 | ○ | ○ | 99 | 0.0 |
| 3 | c | " | 17 | ○ | ○ | 97 | 0.0 |
| Comparative 1 | A | " | 16 | ○ | ○ | 81 | 3.2 |
| Example 2 | B | " | 23 | ○ | ○ | 85 | 8.6 |
| 3 | C | " | 18 | ○ | ○ | 82 | 1.3 |
| 4 | D | " | 8 | x | x | 31 | 43.3 |

Evaluation on two-component developer

| Example/ Comparative Example | toner | carrier | Q/M (μC/g) | after vigorous stirring for 10 hours scattering | fogs on copying ground | total % by weight of 3 channels | contents of fine particles (particle number %) | aggregation properties of developer initial | after 10 hours |
|---|---|---|---|---|---|---|---|---|---|
| Example 1 | a | A | 15 | ○ | ○ | 95 | 0.0 | ○ | ○ |
| 2 | b | " | 25 | ○ | ○ | 99 | 0.0 | ○ | ○ |
| 3 | c | " | 18 | ○ | ○ | 96 | 0.0 | ○ | ○ |
| Comparative 1 | A | " | 12 | Δ | Δ | 67 | 8.9 | ○ | Δ |
| Example 2 | B | " | 13 | Δ | Δ | 73 | 21.3 | ○ | Δ |
| 3 | C | " | 13 | Δ | Δ | 68 | 1.9 | ○ | Δ |
| 4 | D | " | —* | — | — | — | — | Δ | — |

Preparation of Carrier (B) and Carrier (C)

| ingredients | parts by weight |
|---|---|
| Polyester resin (Tafton NE 1110; made by Kao K.K.) | 100 |
| magnetic particles (EPT-1000; made by Toda Kogyo K.K.) | 200 |
| Carbon Black (MA#8; made by Mitsubishi Kasei Kogyo K.K.) | 2 |

The above ingredients were mixed in Henschel Mixer. The obtained mixture was kneaded in two-axial extruder, cooled and coarsely pulverized. The obtained coarse particles were further pulverized finely in a jet-mill and then classified by an air-classifier to obtain polymer fine particles containing the magnetic particles and having mean particle size of 2 μm.

Then, one hundred parts by weight of ferrite carrier F-250HR (mean particle size of 50 μm; made by Powdertech CO., LTD.) were added with 10 parts by weight of polymer fine particles containing magnetic particles. The mixture was treated in Angmill AM-20F (made by Hosokawa Micron K.K.) at 1000 rpm for 40 minutes to obtain carrier having mean particle size of 55 μm (referred to as Carrier B).

Further, Carrier B was heat-treated in Surfusing System (made by Nippon Pneumatic MFG. CO., LTD.) at 400° C. to obtain carrier having mean particle size of 55 μm (referred to as Carrier C).

Preparation of Toner

| ingredients | parts by weight |
|---|---|
| styrene-n-butyl methacrylate resin (softening point of 132° C., glass transition point of 60° C.) | 100 |
| Carbon black (MA#8; made by Mitsubishi Kasei Kogyo K.K.) | 8 |
| Polypropylene of low molecular weight (Biscol 550P; made by Sanyo Kasei Kogyo K.K.) | 3 |
| Nigrosine dye (Bontron N-01; made by Oriento Kagaku Kogyo K.K.) | 5 |

The above-described ingredients were sufficiently mixed in a ball mill and kneaded over a three-roller heated to 140° C. The kneaded mixture was left to stand for cooling the same and coarsely pulverized. Then, the obtained particles were further pulverized into fine particles in a jet mill, followed by being air-classified to obtain. Toner (d) having mean particle size of 8 μm.

Toner (d) (100 parts by weight) were post-treated with hydrophobic silica R-974 (0.2 parts by weight) in Henschel Mixer and then provided for evaluation.

Measurement of Charge Amount (Q/M) and Scattering Amount

Each one and a half grams of the surface-treated toner and 28.5 g of carrier obtained above were put in a 50 cc poly bottle and were stirred at 1200 rpm for 10 minutes to evaluate electrification build up properties, charge amount of toner and toner scattering amount at the same time. The charge amount of toner and the toner scattering amount were also measured after the poly bottle containing toner and carrier at the same ratio as above described was preserved for 24 hours under conditions of 35° C. of temperature and 85% of relative humidity.

The scattering amount was measured with the use of a digital dust measuring apparatus of P5H2 type (manufactured by Shibata Kagakusha K.K.). The dust measuring apparatus was spaced 10 cm apart from a magnet roll, and 2 g of the developer was set on the magnet roll, which was revolved at 2000 rpm. Then, the dust measuring apparatus detected the toner particles scattering about as dust, and displayed the resultant value in the number of counts per minute, i.e. cpm.

The results were shown in Tables 2. In the table 2, the symbol "o" represents the toner scattering amount of 300 cpm or less, the symbol "Δ", the toner can be used practically. The preferable rank is "o".

Evaluation of Copied Images

The toner and the carrier shown in Table 2 were mixed at the ratio (toner/carrier=5/95) to form a two-component developer. The obtained developer was provided for EP-470Z (made by Minolta Camera K.K.) to be evaluated in Example 4 and Comparative Example 5.

Fogs With Respect to Copy

Each of developers as shown in Table 2 was used in the formation of copied images to observe fogs on the copy ground. The degree of fogs was ranked with the symbols "o" and "Δ". The results were shown in Table 2. When the rank is higher than "Δ", the developer can be put into practical use. The preferable rank is "o".

Durability With Respect to Copy

Each of developers as shown in Table 2 was subjected to durability test with respect to 100,000 times of copy of the chart with the B/W ratio of 6%. The results were shown in Table 2. The symbol "o" in the table means there is no problem with respect to practical use and "x" means there are some problems with respect to practical use.

Humid Resistant Test

After the toner and the carrier were put into a poly bottle and left at 35° C. under relative humidity of 85% for 24 hours, copied images, charging amounts and toner scattering amount were evaluated. The result were shown in Table 2.

TABLE 2

| Example/ Comparative Example | toner | carrier | Evaluation on two-component developer: initial Q/M (μC/g) | initial scattering | initial fogs on copying ground | himidity resistance Q/M (μC/g) | himidity resistance scattering | himidity resistance fogs on copying ground | resistance to continuous copy (fogs on copied images) (sheets) 1K | 5K | 10K | 50K | 100K |
|---|---|---|---|---|---|---|---|---|---|---|---|---|---|
| Example 4 | d | C | +26 | o | o | +25 | o | o | o | o | o | o | o |
| Comparative Example 5 | d | B | +24 | o | o | +21 | Δ | Δ | o | o | o | Δ | x |

What is claimed is:

1. A particle production method of a developer component for developing electrostatic latent images comprising;
   - a step of producing core particles,
   - a step of mixing the core particles with fine particles for surface modification by a mixing means to adhere the fine particles to the surfaces of the core particles;
   - a step of fixing the fine particles on the surfaces of the core particles by a fixing means; and
   - a step of heat-treating the core particles having the fine particles fixed on the surfaces thereof in a hot gas current at 200°-600° C. by a heating means to fix firmly the fine particles on the surfaces of the core particles.

2. A particle production method of claim 1, in which the core particles comprise mainly a thermoplastic resin.

3. A particle production method of claim 2, in which the fine particles for surface modification are colorants, charge controlling agents, fluidizing agents or fine resin particles.

4. A particle production method of claim 1, in which the core particles are magnetic particles.

5. A particle production method of claim 4, in which the particles for surface modification are fine resin particles.

6. A particle production method of claim 1, in which the core particles comprise mainly a thermoplastic resin and magnetic powders.

7. A particle production method of claim 6, in which the fine particles for surface modification are colorants, charge controlling agents, non-magnetic inorganic fine particles or fine resin particles.

8. A particle production method of claim 1, in which the fixing means provides impact forces for fine particles in a high speed gas current.

9. A particle production method of claim 1, in which the fixing means is a mechanochemical machine of dry type.

10. A particle production method of claim 1, in which the fixing means is a coating machine of wet type.

11. A particle production method of a toner, one of developer components for developing electrostatic latent images, comprising;
   - a step of producing core particles comprising at least a binder resin,
   - a step of mixing the core particles with fine particles for surface modification by a mixing means to adhere the fine particles to the surfaces of the core particles;
   - a step of fixing the fine particles on the surfaces of the core particles by a fixing means; and
   - a step of heat-treating the core particles having the fine particles fixed on the surfaces thereof in a hot gas current at 200°-600° C. by a heating means to fix firmly the fine particles on the surfaces of the core particles.

12. A particle production method of a toner of claim 11, in which the step of producing core particles comprises;
   - a step of mixing at least the binder resin and the colorant by mixing means to obtain a mixture of the binder resin and the colorant;
   - a step of kneading the mixture under heating to obtain a composition comprising the colorant dispersed in binder resin;
   - a step of pulverizing the composition to obtain pulverized particles; and
   - a step of classifying the pulverized particles by a classifying means to obtain core particles having a specified particle size.

13. A particle production method of a toner of claim 11, in which the step of producing core particles comprises;
   - a step of dissolving the binder resin in an organic solvent;

a step of dispersing the solution in a dispersing medium to form resin particles; and a step of drying the resin particles.

14. A particle production method of a toner of claim 11, in which the step of producing core particles comprises;

a step of dissolving at least a monomer for forming a binder resin in an organic solvent;

a step of dispersing the solution in a dispersing medium with stirring to form oily particles having specified particle size;

a step of polymerizing the monomer in the oily particles to form resin particles; and a step of drying the resin particles to obtain the core particles.

15. A particle production method of a toner for a high speed copying process according to claim 11, in which a thermoplastic resin having the relationships between number average molecular weight (Mn), weight average molecular weight (Mw) and Z average molecular weight (Mz) as shown below is used as the binder resin in claim 11;

$$1000 \leqq Mn \leqq 70000$$

$$40 \leqq Mw/Mn \leqq 70$$

$$2000 \leqq Mz/Mn \leqq 7000$$

16. A particle production method of a toner for an oilless copying process according to claim 11, in which a thermoplastic resin having a glass transition point of 55°-80° C., a softening point of 80°-150° C. and a content of gel components of 5-20 wt %. is used as the binder resin in claim 11.

17. A particle production method of a light-transmittable toner according to claim 11, in which a thermoplastic polyester resin having a glass transition point of 55°-70° C., a softening point of 80°-150° C., a number average molecular weight (Mn) of 2000-15000, a distribution of molecular weight (Mw/Mn) of 3 or less is used as the binder resin in claim 11.

18. A particle production method of a magnetic toner according to claim 11, in which magnetic powder is further comprised in claim 11.

19. A particle production method of a toner of claim 11, in which the fine particles for surface modification are charge controlling agents, colorants, fine resin particles, fine magnetic particles and/or non-magnetic inorganic fine particles.

20. A particle production method of a toner of claim 19, in which 0.001-10 parts by weight of the charge controlling agents are added on the basis of 100 parts by weight of the core particles.

21. A particle production method of a toner of claim 19, in which 1-20 parts by weight of the colorants are added on the basis of 100 parts by weight of the core particles.

22. A particle production method of a toner of claim 19, in which the mean particle size of the particles for surface modification is one fifth or less of the mean particle size of the core particle size.

23. A particle production method of a carrier, one of developer components for developing electrostatic latent images, comprising;

a step of producing core particles comprising magnetic materials, a step of mixing the core particles with fine particles for surface modification by a mixing means to adhere the fine particles to the surfaces of the core particles;

a step of fixing the fine particles on the surfaces of the core particles by a fixing means; and a step of heat-treating the core particles having the fine particles fixed on the surfaces thereof in a hot gas current at 200°-600° C. by a heating means to fix firmly the fine particles on the surfaces of the core particles.

24. A particle production method of a carrier of claim 23, in which the step of producing core particles comprises;

a step of mixing at least a thermoplastic resin and magnetic fine particles by mixing means to obtain a mixture of the thermoplastic resin and magnetic fine particles;

a step of kneading the mixture under heating to obtain a composition comprising magnetic fine particles dispersed in the resin;

a step of pulverizing the composition to obtain pulverized particles; and a step of classifying the pulverized particles by a classifying means to obtain core particles having a specified particle size.

25. A particle production method of a carrier of claim 23, in which the core particles are magnetic particles having specified particle size.

26. A particle production method of a carrier of claim 25, in which the core particles are coated with a resin.

27. A particle production method of a carrier of claim 25, in which the particles for surface modification are resin particles.

28. A particle production method of a carrier of claim 23, in which the fixing means is a mechanochemical machine of dry type.

* * * * *